US008408974B2

(12) United States Patent
Farber et al.

(10) Patent No.: US 8,408,974 B2
(45) Date of Patent: Apr. 2, 2013

(54) ADAPTER FOR ABRASIVE CUTTING WHEELS

(75) Inventors: Donald W. Farber, Towson, MD (US); Brad Nohr, Bel Air, MD (US); David C. Jones, Shrewsbury, PA (US); Mark E. Brunson, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 931 days.

(21) Appl. No.: 12/502,404

(22) Filed: Jul. 14, 2009

(65) Prior Publication Data

US 2011/0014855 A1 Jan. 20, 2011

(51) Int. Cl.
*B24B 41/00* (2006.01)

(52) U.S. Cl. ..... 451/342; 451/344; 451/359; 403/341; 483/33

(58) Field of Classification Search ..... 451/340, 451/342, 344, 359; 403/340, 341, 349; 483/31, 483/33

See application file for complete search history.

(56) References Cited

U.S. PATENT DOCUMENTS

| | | | | |
|---|---|---|---|---|
| 2,178,835 | A | 11/1939 | Hudson | |
| 2,259,345 | A | 10/1941 | Kuzmick et al. | |
| 2,633,008 | A | 3/1953 | Tocci-Guilbert | |
| 2,726,493 | A | 12/1955 | Young et al. | |
| 3,136,100 | A | 6/1964 | Robertson, Jr. | |
| 3,596,415 | A | 8/1971 | Donahue, Jr. | |
| 3,912,411 | A | 10/1975 | Moffat | |
| 4,774,788 | A | 10/1988 | Shacham et al. | |
| 4,979,336 | A | 12/1990 | MacKay, Jr. | |
| 5,152,106 | A | 10/1992 | MacKay, Jr. | |
| 5,207,028 | A | 5/1993 | Timmons | |
| 5,388,942 | A * | 2/1995 | Bonacina et al. | 411/432 |
| 5,516,326 | A | 5/1996 | Virnich | |
| 5,538,464 | A | 7/1996 | MacKay, Jr. | |
| 5,718,621 | A | 2/1998 | Turley | |
| 5,895,317 | A | 4/1999 | Timm | |
| 6,033,294 | A | 3/2000 | Tsai | |
| 6,042,461 | A | 3/2000 | Pearson | |
| 6,569,001 | B2 * | 5/2003 | Rudolf et al. | 451/344 |
| 6,749,496 | B2 | 6/2004 | Mota et al. | |
| 6,893,335 | B2 | 5/2005 | MacKay | |

(Continued)

FOREIGN PATENT DOCUMENTS

| | | |
|---|---|---|
| DE | 1782128 | 3/1958 |
| DE | 2816398 A1 | 10/1979 |

(Continued)

*Primary Examiner* — Eileen P. Morgan
(74) *Attorney, Agent, or Firm* — Harness, Dickey & Pierce, P.L.C.

(57) ABSTRACT

An abrasive disc assembly for a tool having an externally threaded, motor-driven spindle. The assembly includes an abrasive disc having a central bore formed therethrough and a male portion having an internally-threaded hub portion and a flange portion. The outer dimension of the hub portion is sized to be received within the central bore and the internally-threaded hub portion is enmeshingly engagable with the externally threaded, motor-driven spindle. The assembly further comprises an articulating locking finger extending from the male portion and having a retaining surface. The articulating locking finger is deflectable between a locked position and a deflected position. Finally, the assembly includes a female portion having a central cavity and an engagement surface. The central cavity receives the hub portion of the male portion such that the retaining surface of the articulating locking finger engages the engagement surface thereby releasably coupling the male portion to the female portion and retaining the abrasive disc therebetween.

20 Claims, 7 Drawing Sheets

U.S. PATENT DOCUMENTS

| | | | | |
|---|---|---|---|---|
| 6,912,755 | B2 * | 7/2005 | Chen | 15/179 |
| 6,929,538 | B2 | 8/2005 | Yi | |
| 6,942,561 | B2 | 9/2005 | Mota et al. | |
| 7,056,200 | B2 | 6/2006 | Nelson | |
| 7,147,550 | B2 * | 12/2006 | Chen | 451/520 |
| 7,189,152 | B1 | 3/2007 | Ohata | |
| 7,465,222 | B1 * | 12/2008 | Sun et al. | 451/342 |
| 7,578,730 | B2 * | 8/2009 | Chen | 451/466 |
| 7,789,737 | B2 * | 9/2010 | Liersch | 451/344 |
| 2007/0128996 | A1 | 6/2007 | Ficai et al. | |
| 2007/0293380 | A1 * | 12/2007 | Kausch et al. | 483/31 |
| 2008/0182487 | A1 * | 7/2008 | Muller et al. | 451/53 |

FOREIGN PATENT DOCUMENTS

| | | | |
|---|---|---|---|
| EP | 0596842 | A1 | 5/1994 |
| FR | 1451937 | A | 1/1966 |
| JP | 352014291 | | 2/1977 |

* cited by examiner

FIG 1
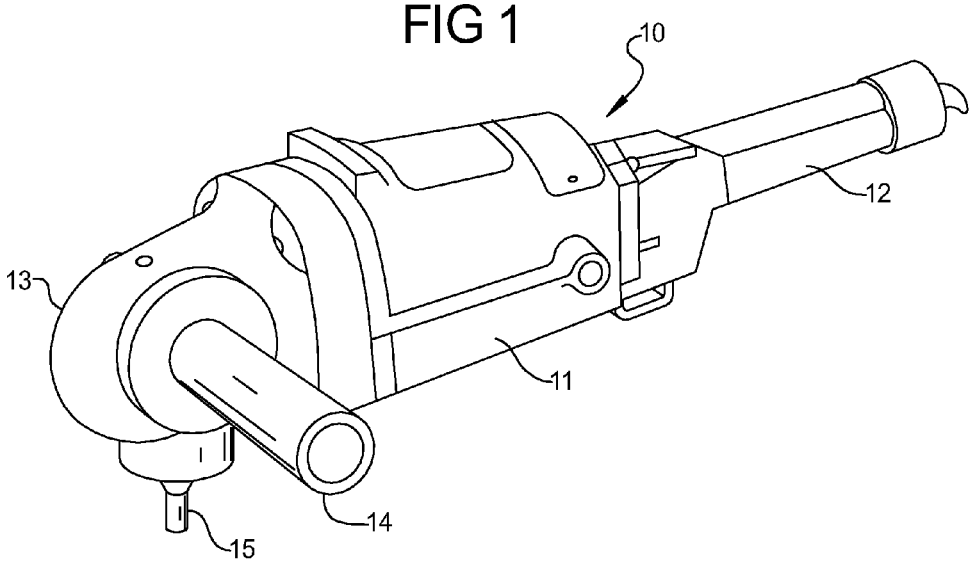
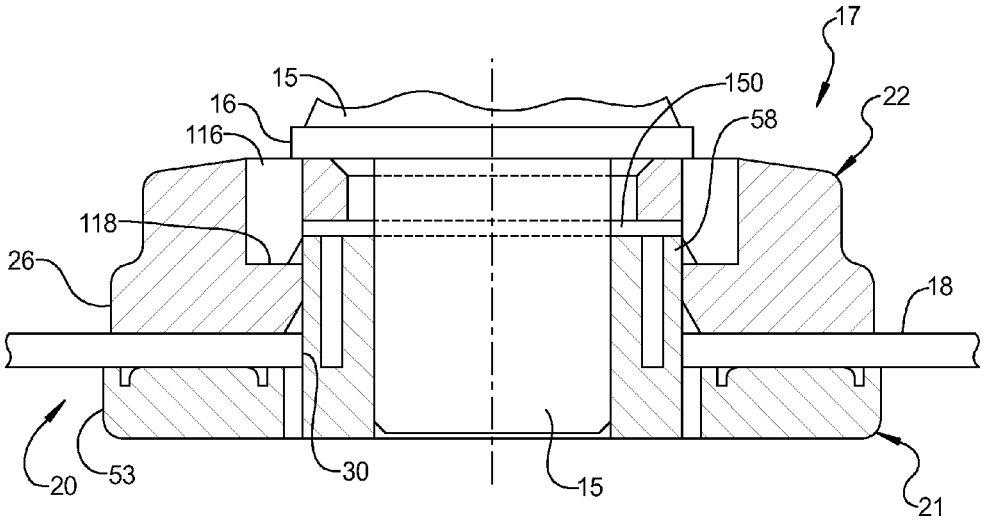
FIG 2

FIG 3
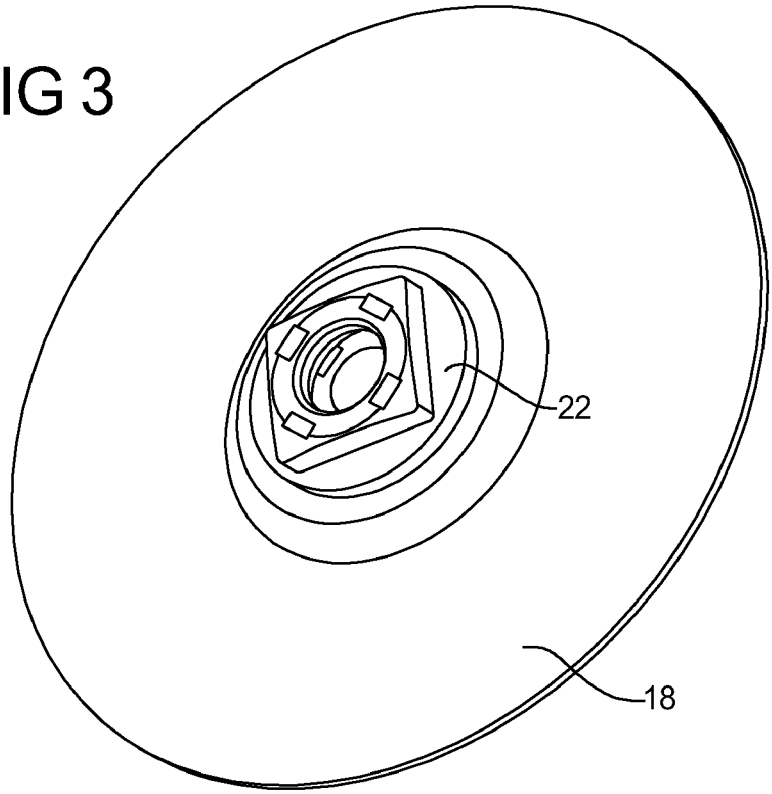
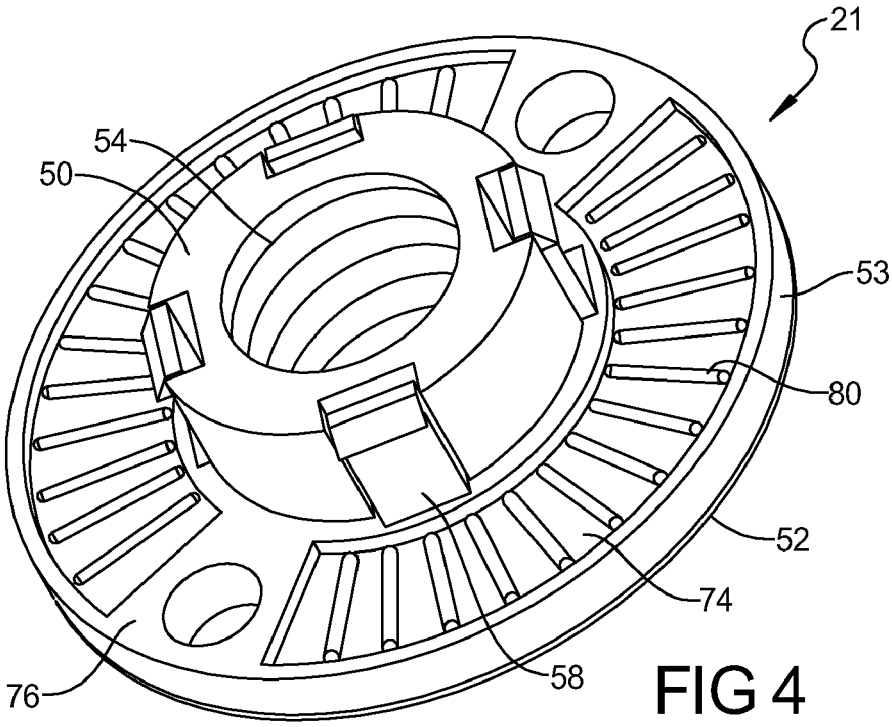
FIG 4

FIG 8
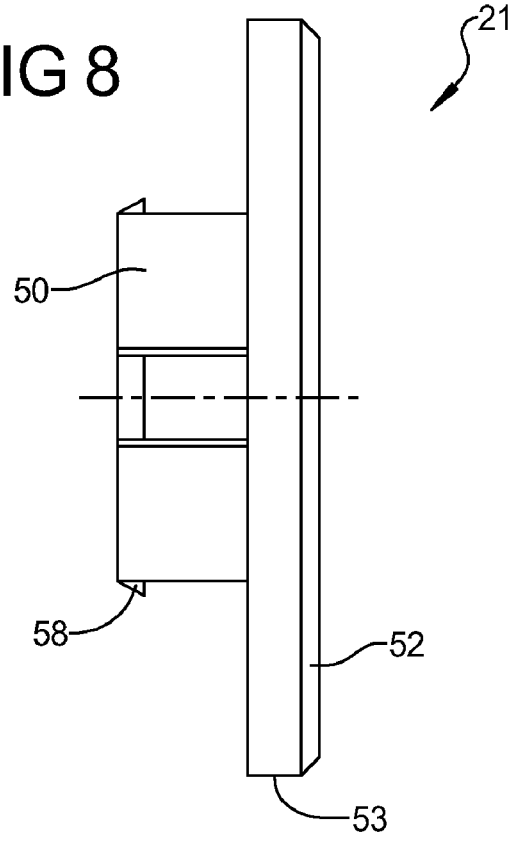
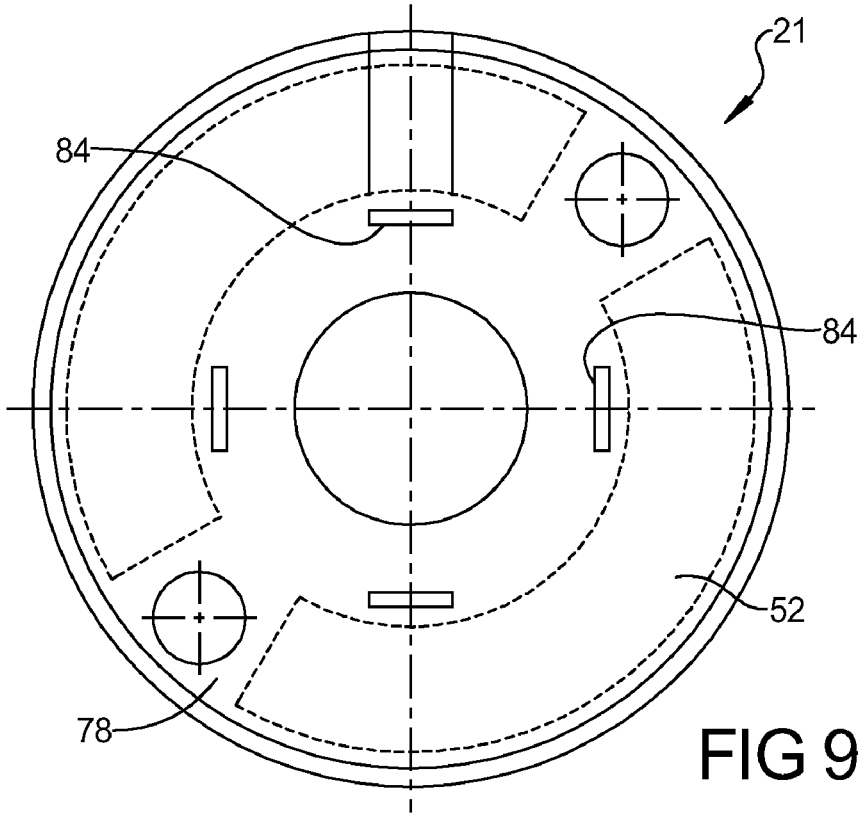
FIG 9

FIG 10
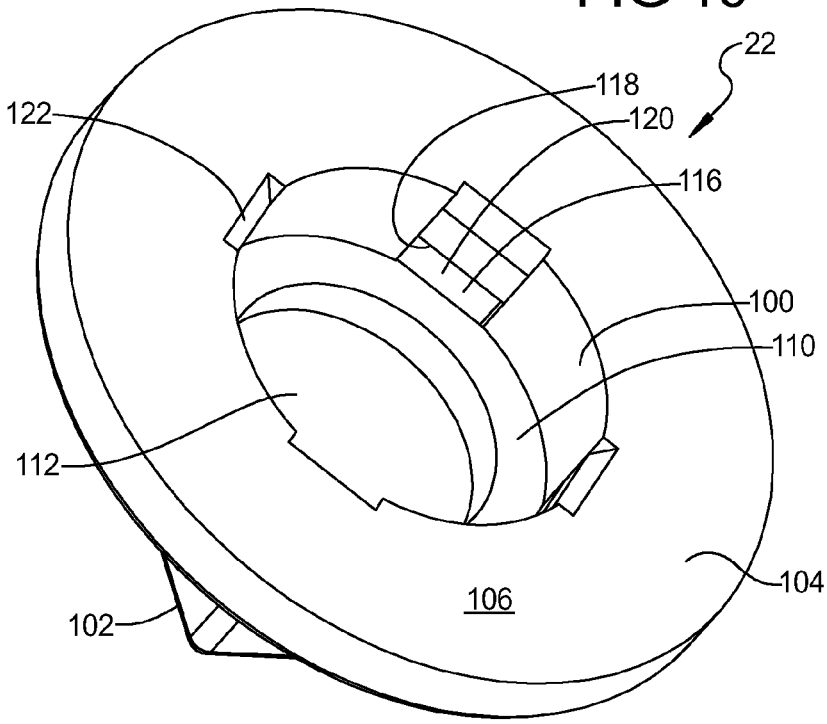
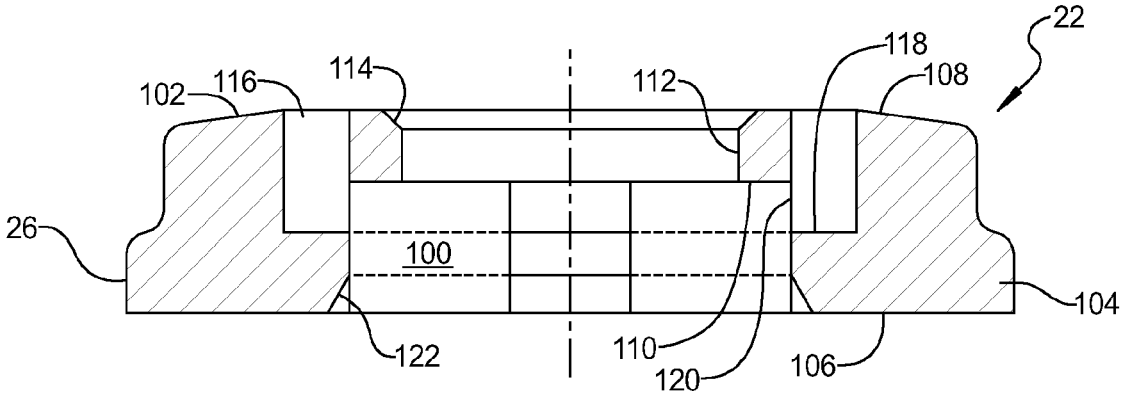
FIG 11

ADAPTER FOR ABRASIVE CUTTING WHEELS

FIELD

The present teachings relate to an improved apparatus for coupling a tool element, such as a grinding wheel, to the output spindle of a power tool, such as a portable grinder.

BACKGROUND AND SUMMARY

This section provides background information related to the present disclosure which is not necessarily prior art.

The grinding wheel used on portable grinders generally consists of an abrasive disc having a centrally located bore for receiving an internally threaded collar nut. The collar nut has a hub portion that fits into the bore in the grinding wheel so that the enlarged hex-shaped head portion of the collar nut abuts the underside of the grinding wheel. The collar nut is adapted to be mounted to the externally threaded spindle of the grinder. Typically, a support flange is positioned on the spindle between the grinding wheel and an annular shoulder 16 formed on the spindle to provide backing support for the grinding wheel. The support flange is typically comprised of a metal stamping that is configured to engage the backside of the abrasive disc around its outer radial end. The direction of rotation of the spindle when the grinder is energized is such that the collar nut will self-thread onto the spindle until a tight frictional engagement is provided between the support flange and the grinding wheel. The grinding wheel can then be further tightened onto, or subsequently removed from, the spindle by applying a wrench to the collar nut.

With conventional abrasive disc subassemblies the central bore in the abrasive disc through which the spindle extends is circular in shape. Similarly, the hub portion of the collar nut that fits into the bore of the disc is also circular in cross-section. The collar nut in such conventional assemblies is not permanently affixed to the abrasive disc, but rather is intended to be reused when a worn disc is replaced. Thus, the collar nut of conventional assemblies risk being lost or misplaced. Moreover, the application of driving torque from the spindle to the abrasive disc is solely through the frictional interfaces between the abrasive disc and the spindle directly or between the abrasive disc and the supporting flange and the supporting flange and the spindle. Consequently, under load the abrasive disc assembly may slip at either of these frictional interfaces. To combat slippage, abrasive disc subassemblies are frequently tightened onto the spindle to such a degree that subsequent removal becomes difficult.

To alleviate these problems, various "hubbed"-type abrasive disc subassemblies have been proposed, such as that shown in U.S. Pat. No. 4,694,615 to Mackay, Jr. Hubbed-type abrasive disc subassemblies include a backing flange that is permanently affixed to the backside of the abrasive disc by the hub portion of the collar nut which thus becomes an integral part of the assembly. The entire assembly is thus intended to be discarded when the disc is worn. Many hubbed-type grinding wheels are generally intended to be used in combination with specially designed support flanges adapted for engaging driving surfaces on the backing flange affixed to the disc.

With each of the known forms of grinding wheel subassemblies, driving torque is transferred from the output spindle of the grinder to the grinding wheel via a frictional coupling, either between the output spindle and the grinding wheel directly, or through an intermediary support flange which either frictionally engages the backside of the grinding wheel or a backing flange permanently affixed thereto. Frictional couplings of the above-described type without support flanges are prone to slippage, or in the alternative, must be tightened to such a degree as to subsequently make it difficult to remove a worn wheel. While the hubbed-type grinding wheels are much less susceptible to slippage problems, they are substantially more expensive than conventional non-hubbed grinding wheels and consequently are not as widely used.

Furthermore, it is desirable to provide a grinding wheel assembly that is compatible with both United States and European safety standards.

SUMMARY

This section provides a general summary of the disclosure, and is not a comprehensive disclosure of its full scope or all of its features.

According to the principles of the present teachings, an abrasive disc assembly for a tool having an externally threaded, motor-driven spindle is provided. The assembly includes an abrasive disc having a central bore formed therethrough and a male portion having an internally-threaded hub portion and a flange portion. The outer dimension of the hub portion is sized to be received within the central bore and the internally-threaded hub portion is enmeshingly engagable with the externally threaded, motor-driven spindle. The assembly further comprises an articulating locking finger extending from the male portion and having a retaining surface. The articulating locking finger is deflectable between a locked position and a deflected position. Finally, the assembly includes a female portion having a central cavity and an engagement surface. The central cavity receives the hub portion of the male portion such that the retaining surface of the articulating locking finger engages the engagement surface thereby releasably coupling the male portion to the female portion and retaining the abrasive disc therebetween.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a perspective view illustrating a typical power tool to which the present teachings may be applied;

FIG. 2 is an elevational, sectional view illustrating the abrasive disc assembly of the present teachings mounted on a externally threaded, motor-driven spindle;

FIG. 3 is a perspective view illustrating the label side of the abrasive disc assembly according to the present teachings;

FIG. 4 is a perspective view illustrating the male portion;

FIG. 8 is a side view illustrating the male portion of FIG. 4;

FIG. 9 is an exposed side view illustrating the male portion of FIG. 4;

FIG. 10 is a perspective view illustrating the female portion;

FIG. 11 is a sectional view of the female portion of FIG. 10;

Corresponding reference numerals indicate corresponding parts throughout the several views of the drawings.

DETAILED DESCRIPTION

Figure 5:
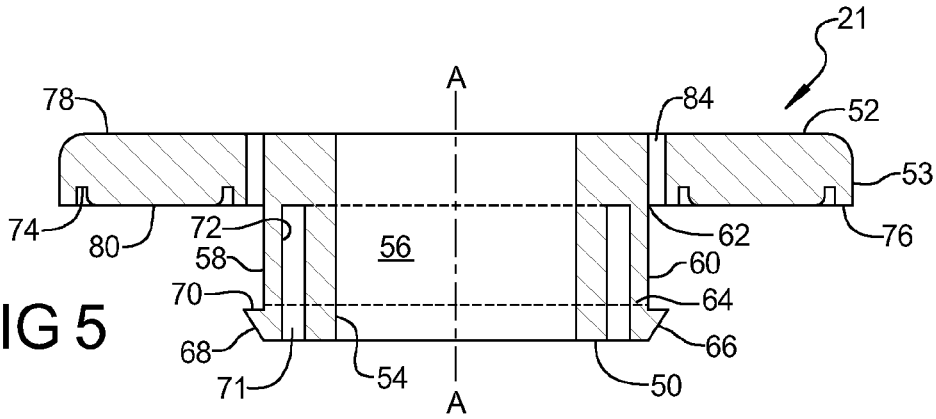
FIG. 5 is a sectional view of the male portion of FIG. 4.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

With reference to FIG. 1, there is illustrated a portable electric grinder 10 with which the teachings of the present disclosure may be applied. It will be appreciated by those skilled in the art, however, that the grinder 10 is only exemplary of a wide variety of power tools to which the teachings may be applied. With this in mind, the grinder 10 generally comprises a motor housing 11, a switch handle 12, a gear case 13, an auxiliary handle 14, and a right-angle spindle 15 for mounting a grinding wheel assembly or other tool element assembly. The guard for the grinder has been removed in FIG. 1 for the sake of clarity. The spindle 15 is externally threaded and has an annular shoulder 16 (FIG. 2) formed thereon.

As seen in FIG. 2, a tool element assembly, or abrasive disc assembly 17, can be threadably mounted on the spindle 15. The abrasive disc assembly 17 includes a depressed center abrasive disc 18 that is coupled to an internally threaded hub assembly 20. It should be noted at this point that while the preferred embodiments are described and illustrated in combination with depressed center abrasive discs, the present teachings are equally applicable to flat "type 1" abrasive discs as well.

The internally threaded hub assembly 20 comprises an internally threaded male portion 21 and an interconnecting female portion 22. The abrasive disc assembly 17 is positioned on the spindle 15 of the grinder so that a back portion of female portion 22 abuts the annular shoulder 16 of the spindle. In addition, the female portion 22 is typically configured so that the outer distal end portion 26 supports the backside of the abrasive disc 18 radially outward of the depressed center portion of the abrasive disc 18 as shown in FIG. 2. Due to the direction of rotation of the spindle 15 relative to the threads on the spindle, when the grinder is energized the male portion 21 of the hub assembly 20 will self-thread onto the spindle until the backside of the abrasive disc 18 bears against the distal end portion 26 of female portion 22 as seen in FIG. 3. Female portion 22 thus also provides a frictional drive coupling between the spindle 15 of the grinder and the abrasive disc 18.

With reference to FIGS. 4-9, in some embodiments, the male portion 21 comprises a central, circular hub portion 50 extending orthogonally from a circumferential flange 52. In some embodiments, hub portion 50 is sized to be received within a corresponding bore 30 (FIG. 2) of abrasive disc 18 in a press fit configuration. This press fit configuration provides proper engagement of the abrasive disc 18 relative to spindle 15 of grinder 10, such that during operation positive control of abrasive disc 18 can be achieved. Obviously, as will be appreciated by those skilled in the art, it is not critical to the present teachings that the bore 30 in the abrasive disc 18 and the hub portion 50 of the male portion 21 be circularly shaped. Consequently, alternative shapes could include square, spline, pentagonal, hexagonal, etc. In addition, it will further be appreciated that other means for affixing the male portion 21 to the abrasive disc 18 can be used than those disclosed herein. Additionally, an adhesive may also be used if desired. In some embodiments, circumferential flange 52 extends radially from hub portion 50 outward to a distal end portion 53 such that circumferential flange 52 generally supports the front side of the abrasive disc 18 radially outward of the depressed center portion of the abrasive disc 18 as shown in FIG. 2.

Referring again to FIGS. 4-10, hub portion 50 of male portion 21 further comprises internally formed threads 54 extending within a central bore 56. The threads 54 are sized to enmeshingly engage with corresponding threads (not shown) of spindle 15 to provide a locking relationship between abrasive disc assembly 17 and spindle 15.

With particular reference to FIGS. 4 and 5, male portion 21 further comprises a plurality of articulating locking fingers 58 that are sized to lockingly engage corresponding features disposed in female portion 22 as will be described in detail herein. Articulating locking fingers 58 generally comprise an elongated section 60 extending from a proximal end 62 integrally formed with circumferential flange 52 and extending orthogonally from flange 52 to a proximal end 64 having an engaging feature 66. In some embodiments, engaging feature 66 can comprise an enlarged tip portion 68 that extends beyond elongated section 60 to form a retaining surface 70. Retaining surface 70, as will be described herein, is sized to engage a corresponding surface on female portion 22 to effect a positive and reliable coupling engagement between male portion 21 and female portion 22. In some embodiments, in large tip portion 68 can comprise a sloped surface in the direction of insertion to aid in the coupling of male portion 21 and female portion 22. As should be appreciated, articulating locking fingers 58 are configured to articulate via elastic deformation generally about proximal end 62 and, to some extent, along a length of elongated section 60. To this end, a space or void 71 is formed along a back side 72 of articulating locking fingers 58 to permit deflection of articulating locking fingers 58 toward a central axis A-A. Void 71 should be sized to permit sufficient deflection of articulating locking fingers 58 such that enlarged tip portion 68 can fit within central cavity 100 of female portion 22 (FIG. 11).

With particular reference to FIGS. 2, 5, 7, and 9, in some embodiments, articulating locking fingers 58 are positioned radially and equidistantly about central axis A-A. In some embodiments, such as is illustrated, four articulating locking fingers 58 can be used. However, it should be appreciated that depending upon the size of abrasive disc 18, the operating environment, and the materials used, any number of articulating locking fingers 58 can be used. It should also be appreciated that, when male portion 21 is formed through injection molding, release apertures 84 (FIGS. 2, 5, and 9) can be employed to permit the forming of articulating locking fingers 58 and retaining surface 70 of enlarged tip portion 68. However, depending upon various mold configurations, these release apertures 84 can be eliminated.

Figure 6:
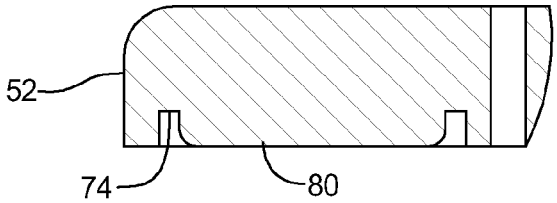
FIG. 6 is an enlarged sectional view of the depression of the male portion of FIG. 4.
Figure 7:
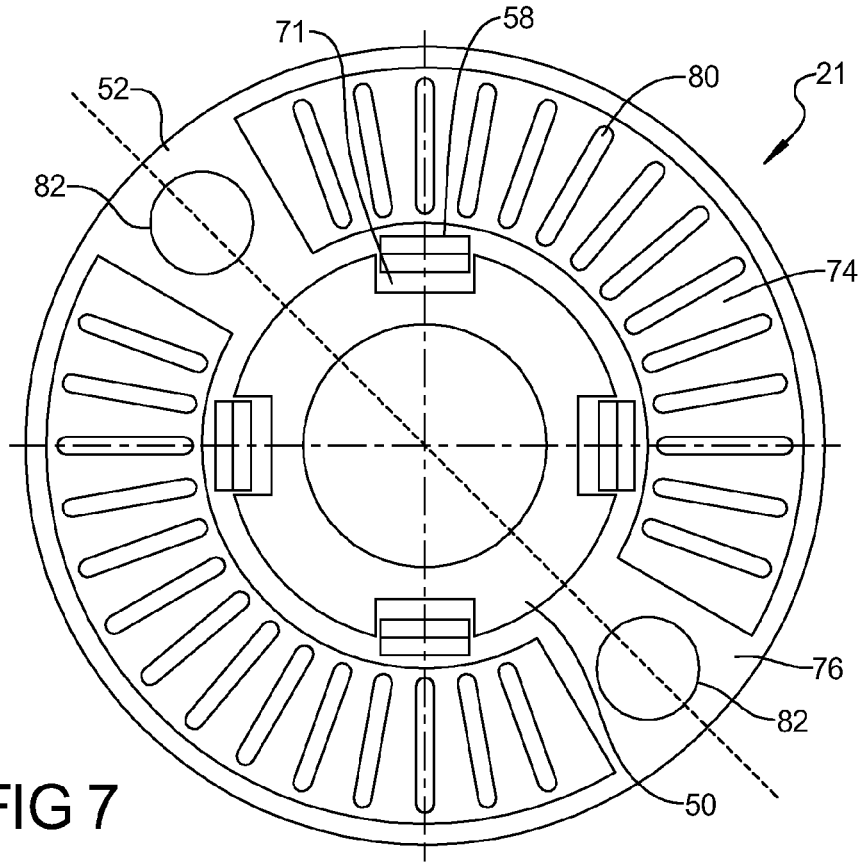
FIG. 7 is a contact side view illustrating the male portion of FIG. 4.

In some embodiments, circumferential flange 52 of male portion 21 can comprise one or more depressions 74 formed along a contact side 76 of circumferential flange 52. Contact side 76 of flange 52 is generally adjacent to abrasive disc 18 of abrasive disc assembly 17, such that contact side 76 is opposite of exposed side 78 as seen in FIG. 5. In some embodiments, depression 74 can extend to a depth sufficient to permit application of an adhesive therein for bonding with abrasive disc 18 during assembly. In some embodiments, depression 74 can comprise a plurality of radially extending features 80 for managing the distribution and/or flow of an associated adhesive. As seen in FIGS. 4-6, radially extending features 80 can be sized such that they extend to a level generally planar with the surface of contact side 76. In some embodiments, it is desirable that radially extending features 80 do not extend above the surface of contact side 76 such that they do not interfere or engage with the abrasive disc 18. It should be appreciated that radially extending features 80 are optional and as such the number of them used is highly variable.

In some embodiments, male portion 21 further comprises a pair of spanner holes 82 formed through circumferential flange 52 for receiving a spanner wrench to tighten the male portion 21, and consequently abrasive disc assembly 17, to the spindle 15, as well as to loosen the abrasive disc assembly 17 for removal and replacement thereof. It should be appreciated that spanner holes 82 can be configured and spaced relative to each other to accommodate any one of a number of spanner wrenches or tools.

With particular reference to FIGS. 10-14, female portion 22 will now be described in greater detail. In some embodiments, female portion 22 comprises a central, square-shaped hub portion 102 extending orthogonally from a circumferential flange 104. In some embodiments, hub portion 102 is sized and shaped to engage a tool, such as a wrench, for receiving a conventional wrench or similar tool. It should be appreciated that the length of hub portion 102 is preferably chosen to permit a conventional wrench or similar tool to fit between abrasive disc 18 and any enlarged features of spindle 15 or grinder 10. However, it should be appreciated that hub portion 102 can define any one of a number of shapes, such as, but not limited to, circular, hexagon, octagonal, and the like.

In some embodiments, circumferential flange 104 extends radially from hub portion 102 outward to the distal end portion 26 such that circumferential flange 104 generally supports the back side of the abrasive disc 18 radially outward of the depressed center portion of the abrasive disc 18 as shown in FIG. 2. Circumferential flange 104 comprises a contact side 106 and an opposing exposed side 108. In some embodiments, contact side 106 is generally planar for engaging a backside of abrasive disc 18 when female portion 22 is coupled with male portion 21. However, it should be appreciated that contact side 106 may define other shapes and/or contours desired to cooperate with abrasive disc 18 or features thereon and/or other assembly elements, such as washers, rings, gaskets, and the like. Likewise, exposed side 108 of female portion 22 can be generally planar for contacting annular shoulder 16 of spindle 15 as seen in FIG. 2. However, it should be appreciated that exposed side 108 may define other shapes and/or contours desired to cooperate with annular shoulder 16 or features thereon and/or other assembly elements, such as washers, rings, gaskets, and the like.

Figure 12:
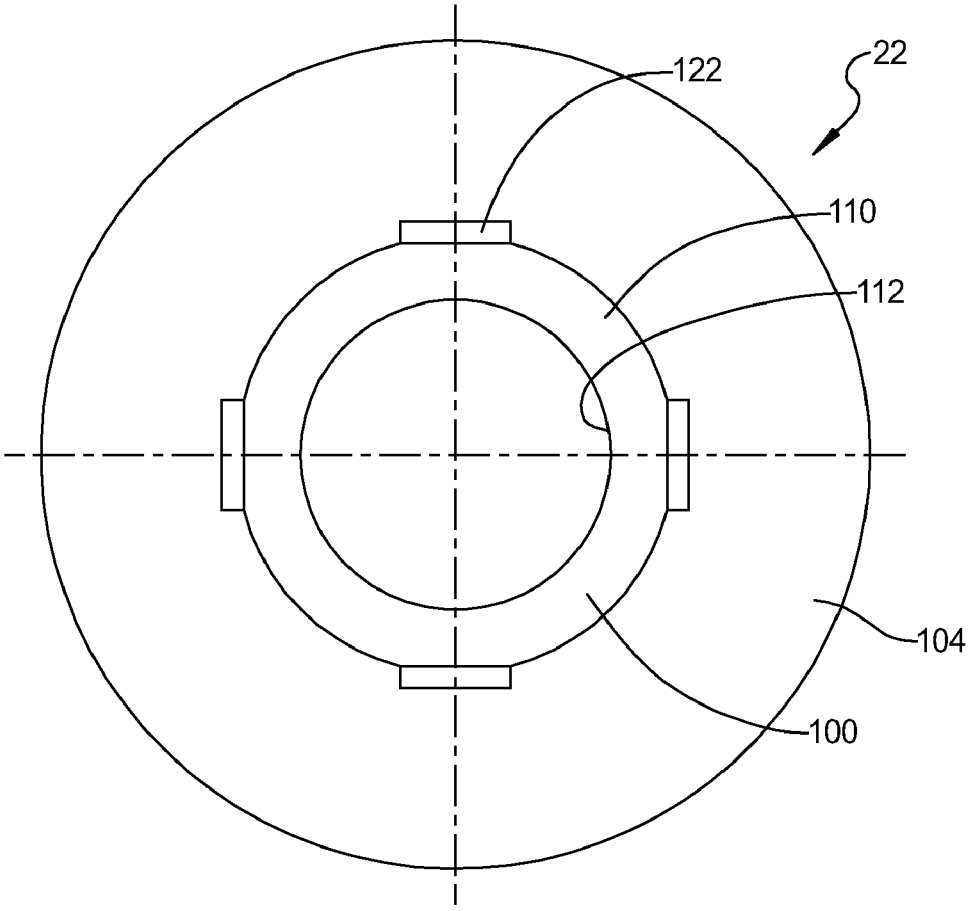
FIG. 12 is a contact side view illustrating the female portion of FIG. 10.
Figure 13:
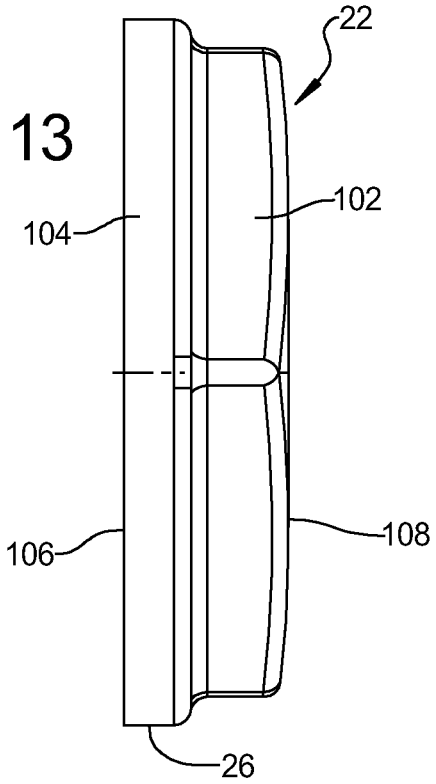
FIG. 13 is a side view illustrating the female portion of FIG. 10.
Figure 14:
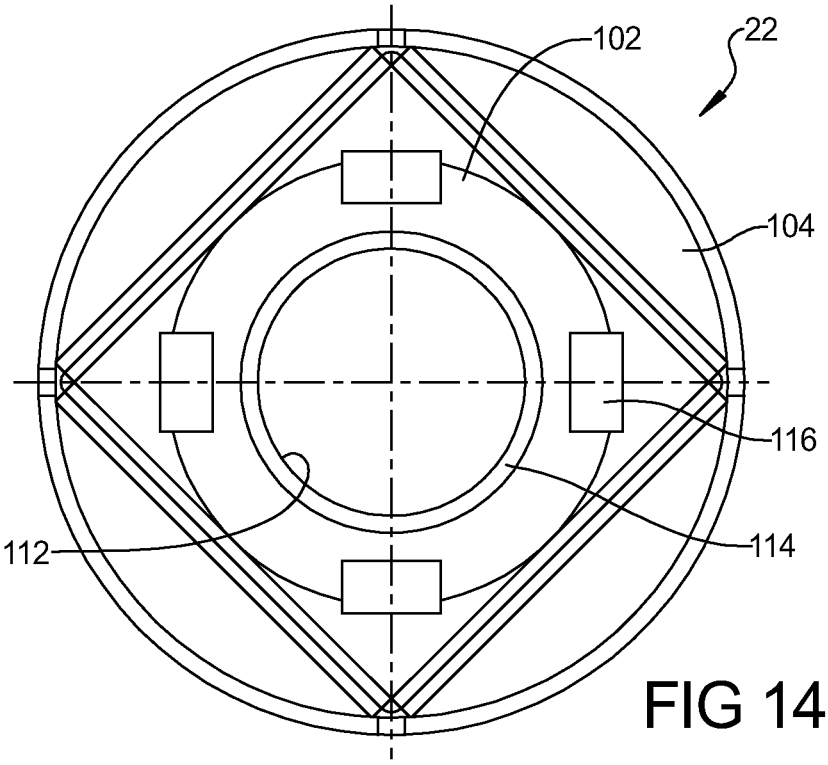
FIG. 14 is an exposed side view illustrating the female portion of FIG. 10.

Still referring to FIGS. 10-12, in particular, female portion 22 further comprises the central cavity 100 generally extending from an open end formed in contact side 106 of circumferential flange 104 and into a portion of hub portion 102 terminating at a cavity bottom 110. Central cavity 100 is sized and shaped to cooperate with hub portion 50 of male portion 21. That is, in some embodiments, central cavity 100 is circular in shape and sized to slidably receive hub portion 50 of male portion 21. A bore 112, coaxially aligned with central cavity 100, extends from central cavity 100 (specifically from cavity bottom 110) to exposed side 108 of female portion 22. In some embodiments, bore 112 is sized to receive the threaded end of spindle 15 therethrough (i.e. a diameter of bore 112 is greater than a diameter of the threaded portion of spindle 15), yet permit exposed side 108 of female portion 22 to contact annular shoulder 16 of spindle 15 (i.e. a diameter of bore 112 is less than a diameter of annular shoulder 16 of spindle 15). In some embodiments, bore 112 can comprise a chamfer 114 along the edge with exposed side 108 to improve engagement of abrasive disc assembly 17 on spindle 15.

With particular reference to FIGS. 2, 10, 11, and 12, female portion 22 comprises a plurality of engagement bores 116 formed in at least one of hub portion 102 and circumferential flange 104. Each of the plurality of engagement bores 116 are positioned and shaped to couple with each of the respective articulating locking fingers 58 of male portion 21 to affect a simple and reliable locked assembly of male portion 21 and female portion 22. Specifically, in some embodiments, engagement bores 116 comprise cavities having an engagement surface 118 defining a plane generally orthogonal to axis A-A. Engagement bores 116 are each open to central cavity 100 via a port 120 (FIG. 10) such that retaining surface 70 of enlarged tip portion 68 of articulating locking fingers 58 engages engagement surface 118 to retain male portion 21 coupled to female portion 22 (see FIG. 2).

In some embodiments, engagement bores 116 are positioned radially and equidistantly about central axis A-A, an in alignment with articulating locking fingers 58 for engagement therewith. In some embodiments, such as is illustrated, four engagement bores 116 can be used. However, it should be appreciated that depending upon the size of abrasive disc 18, the operating environment, and the materials used, any number of articulating locking fingers 58 and engagement bores 116 can be used.

As seen in FIG. 10, female portion 22 can further comprise a chamfer 122 formed either about an entire edge defined between contact side 106 and central cavity 100 or at predetermined positions aligned with engagement bores 116 (as shown in FIG. 10) to cooperate with the sloped surface of enlarged tip portion 68 of articulating locking finger 58 to urge articulating locking fingers 58 inward toward axis A-A during insertion of male portion 21 into female portion 22.

In some embodiments, during assembly of abrasive disc assembly 17, male portion 21 is first inserted into bore 30 of abrasive disc 18 from the abrasive side of abrasive disc 18 via a press fit interface such that contact side 76 contacts abrasive disc 18. In this manner the male portion 21 can be tightly secured to the abrasive disc 18 without materially altering the production process for the abrasive disc. Once inserted, the male portion 21 will remain connected with abrasive disc 18 without further aid. Female portion 22 can then be coupled to male portion 21 from an opposing side of abrasive disc 18. To this end, female portion 22 is positioned upon male portion 21 such that each of the articulating locking fingers 58 of male portion 21 are aligned with engagement bores 116 and, in some embodiments, the sloped surface of enlarged tip portion 68 engages chamfer 122 formed on female portion 22 such that with addition insertion of male portion 21 into female portion 22, articulating locking finger 58 is urged inwardly within void 71 to permit female portion 22 to slide down over male portion 21. Articulating locking fingers 58 will remain in this deflected position until retaining surface 70 is generally elevationally aligned with engagement surface 118. At this time, the biasing force of articulating locking fingers 58 causes articulating locking fingers 58 to expand outwardly relative to axis A-A and retaining surface 70 to contact engagement surface 118 to defining a locking engagement (in some embodiments, a snap fit), thereby sandwiching and relating abrasive disc 18 therebetween. In this arrangement, as seen in FIG. 2, it can be see that a space 150 is provided between hub portion 50 of male portion 21 and cavity bottom 110 of central cavity 100 of female portion 22. The assembly of male portion 21, female portion 22, and abrasive disc 18 can now define abrasive disc assembly 17.

Accordingly, it will be appreciated that when the abrasive disc assembly 17 according to the present teachings is threaded onto the spindle 15 of the grinder, a positive drive coupling is created between the spindle 15 and the abrasive disc 18 due to the frictional coupling between the male portion 21 and female portion 22 together with the abrasive disc 18. Moreover, the threading of abrasive disc assembly 17 onto spindle 15 results in a enmeshing engagement of male portion 21 with spindle 15 resulting in a compression of abrasive disc 18 and female portion 22 between male portion 21 and annular shoulder 16 form a unitary assembly. The compression further serves to frictionally join abrasive disc 18 to spindle 15 through the contact of contact side 76 of male portion 21 and contact side 104 of female portion 22 with abrasive disc 18.

The foregoing description of the embodiments has been provided for purposes of illustration and description. It is not intended to be exhaustive or to limit the teachings. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the teachings, and all such modifications are intended to be included within the scope of the teachings.

What is claimed is:

1. An abrasive disc assembly for use with a power tool having an externally threaded, motor-driven spindle, said abrasive disc assembly comprising:

an abrasive disc having a central bore formed therethrough;

a male portion having an internally-threaded hub portion and a flange portion, an outer dimension of said hub portion being sized to be received within said central bore of said abrasive disc, said internally-threaded hub portion adapted to be threadedly engagable with the externally threaded, motor-driven spindle of the power tool;

an articulating locking finger extending from said male portion and having a retaining surface, said articulating locking finger being deflectable between a locked position and a deflected position; and a female portion having a central cavity and an engagement surface, said central cavity receiving said hub portion of said male portion such that said retaining surface of said articulating locking finger engages said engagement surface of said female portion thereby releasably coupling said male portion to said female portion and retaining said abrasive disc between said flange portion of said male portion and an axial face of said female portion.

2. The abrasive disc assembly according to claim 1 wherein said articulating locking finger is generally longitudinally parallel to a central axis of said male portion.

3. The abrasive disc assembly according to claim 1 wherein said articulating locking finger comprises:

an elongated section extending from a proximal end integrally formed with said male portion and terminating at a distal end; and an enlarged tip portion disposed on said distal end, said enlarged tip portion having said engagement retaining surface, wherein said articulating locking finger is deflectable along said elongated section.

4. The abrasive disc assembly according to claim 2, further comprising:

a void formed adjacent said articulating locking finger to permit deflection of said articulating locking finger between said locked position and said deflected position.

5. The abrasive disc assembly according to claim 1, further comprising:

a depression formed in said flange portion of said male portion; and a plurality of radially extending features disposed in said depression, said plurality of radially extending features having a height that is less than or equal to a depth of said depression such that said plurality of radially extending features do not extend above a surface adjacent said depression.

6. The abrasive disc assembly according to claim 1, further comprising:

a pair of spanner holes formed in said flange of said male portion, a size and spacing of said pair of spanner holes being sufficient for engagement with a spanner wrench.

7. The abrasive disc assembly according to claim 1, further comprising:

an engagement bore formed in said female portion, said engagement bore extending from an exposed side of said female portion and terminating at said engagement surface, said engagement bore opening to said central cavity for receiving at least a portion of said articulating locking finger therein.

8. The abrasive disc assembly according to claim 1 wherein said female portion comprises:

a hub portion; and a flange portion radially extending from said hub portion.

9. The abrasive disc assembly according to claim 8 wherein said hub portion of said female portion has an external square shape engagable by a tool.

10. The abrasive disc assembly according to claim 1 wherein said articulating locking finger comprises a plurality of articulating locking fingers radially disposed about a central axis of said male portion.

11. An abrasive disc assembly for use with a power tool having an externally threaded, motor-driven spindle, said assembly comprising:

an abrasive disc having a central bore formed therethrough;

a male portion having an internally-threaded hub portion and a flange portion, said internally-threaded hub portion extending through said central bore of said abrasive disc, said internally-threaded hub portion being adapted to be threadedly engagable with the externally threaded, motor-driven spindle of the power tool;

a plurality of articulating locking fingers extending from said male portion and having a retaining surface, said plurality of articulating locking fingers being at least partially disposed with said central bore of said abrasive disc and each deflectable between a locked position and a deflected position; and a female portion having a central cavity and a plurality of engagement surfaces, said central cavity of said female portion receiving said hub portion of said male portion such that said retaining surfaces of said plurality of articulating locking fingers engage said plurality of engagement surfaces thereby releasably coupling said male portion to said female portion and retaining said abrasive disc between said flange portion of said male portion and an axial face of said female portion.

12. The abrasive disc assembly according to claim 11 wherein said plurality of articulating locking fingers each comprises:

an elongated section extending from a proximal end integrally formed with said male portion and terminating at a distal end; and an enlarged tip portion disposed on said distal end, said enlarged tip portion having said engagement retaining surface, wherein said articulating locking finger is deflectable along said elongated section.

13. The abrasive disc assembly according to claim 12 wherein said plurality of articulating locking fingers are each elastically deflectable.

14. The abrasive disc assembly according to claim 12 wherein said plurality of articulating locking fingers are each deflectable due to material properties.

15. The abrasive disc assembly according to claim 11, further comprising:

a plurality of voids each formed adjacent to a corresponding one of said plurality of articulating locking fingers to permit deflection of said articulating locking fingers between said locked position and said deflected position.

16. The abrasive disc assembly according to claim 11, further comprising:

a depression formed in said flange portion of said male portion; and a plurality of radially extending features disposed in said depression, said plurality of radially extending features having a height that is less than or equal to a depth of said depression such that said plurality of radially extending features do not extend above a surface adjacent said depression.

17. The abrasive disc assembly according to claim 11, further comprising:

a pair of spanner holes formed in said flange of said male portion, a size and spacing of said pair of spanner holes being sufficient for engagement with a spanner wrench.

18. The abrasive disc assembly according to claim 11, further comprising:

a plurality of engagement bores formed in said female portion, said plurality of engagement bores each extending from an exposed side of said female portion and terminating at said plurality of engagement surfaces, said plurality of engagement bores opening to said central cavity for receiving at least a portion of said plurality of articulating locking fingers therein.

19. The abrasive disc assembly according to claim 11 wherein said female portion comprises:

a hub portion; and a flange portion radially extending from said hub portion.

20. The abrasive disc assembly according to claim 19 wherein said hub portion of said female portion has an external square shape.

* * * * *